United States Patent [19]

Schneider

[11] Patent Number: 4,728,306

[45] Date of Patent: Mar. 1, 1988

[54] MARINE PROPULSION AUXILIARY COOLING SYSTEM

[75] Inventor: Charles R. Schneider, Oshkosh, Wis.

[73] Assignee: Brunswick Corporation, Skokie, Ill.

[21] Appl. No.: 946,756

[22] Filed: Dec. 29, 1986

[51] Int. Cl.[4] ..... F01D 7/14; B63H 21/38

[52] U.S. Cl. ..... 440/1; 440/88; 123/541; 123/41.02; 123/41.31

[58] Field of Search ..... 440/1, 2, 88; 123/41.31, 41.05, 541, 41.02, 41.44

[56] References Cited

U.S. PATENT DOCUMENTS

| | | | |
|---|---|---|---|
| Re. 26,400 | 6/1968 | Jasper | 123/541 |
| 2,466,440 | 7/1942 | Kiekhaefer | 415/141 |
| 2,791,186 | 1/1954 | Alden | 123/41.31 |
| 3,835,822 | 9/1974 | Mickle | 123/41.31 |
| 3,859,951 | 1/1975 | Woodfill | 440/38 |
| 4,220,121 | 9/1980 | Maggiorana | 123/41.08 |
| 4,294,470 | 10/1981 | Tucker | 285/5 |
| 4,306,614 | 12/1981 | Maggiorana | 165/35 |
| 4,372,011 | 2/1983 | Aranyos | 24/20 TT |
| 4,392,779 | 7/1983 | Bloemers | 415/141 |
| 4,491,117 | 1/1985 | Koide | 123/541 |
| 4,504,238 | 12/1985 | Neisen | 440/89 |
| 4,514,106 | 4/1985 | Slager | 403/190 |
| 4,573,318 | 3/1986 | Entringer | 60/310 |

FOREIGN PATENT DOCUMENTS

| | | | |
|---|---|---|---|
| 0106123 | 6/1983 | Japan | 123/41.31 |

*Primary Examiner*—Joseph F. Peters, Jr.
*Assistant Examiner*—Edwin L. Swinehart
*Attorney, Agent, or Firm*—Andrus, Sceales, Starke & Sawall

[57] ABSTRACT

A marine propulsion auxiliary cooling system is provided by an electric auxiliary water pump (36) pumping sea water to cool the engine (4) and/or fuel line (14) after turn off of the engine to prevent vaporization of the fuel, or in response to another given engine condition.

9 Claims, 3 Drawing Figures

MARINE PROPULSION AUXILIARY COOLING SYSTEM

BACKGROUND AND SUMMARY

The invention relates to marine propulsion systems, and cooling systems therefor. The invention particulary arose from efforts to prevent vaporization of fuel, which is a particular problem in a marine environment with an engine in a closed heat-retentive compartment.

When a marine engine is turned off, the temperature in the engine compartment continues to rise due to engine heat, which in turn heats up the fuel line and fuel pump, causing vapor lock (fuel push back, percolation, spewing). Prior solutions include placing insulation around the fuel line to isolate same from the heat.

In the present invention, after the engine is turned off, off-condition cooling means prevents vaporization of the fuel caused by heat from the engine. Upon turn-off of the engine, auxiliary cooling water is supplied to cool the engine and/or fuel, to prevent fuel vaporization.

In a further aspect of the invention, an auxiliary water pump responds to a given engine condition for pumping auxiliary cooling water to the engine.

DETAILED DESCRIPTION

Figure 1:
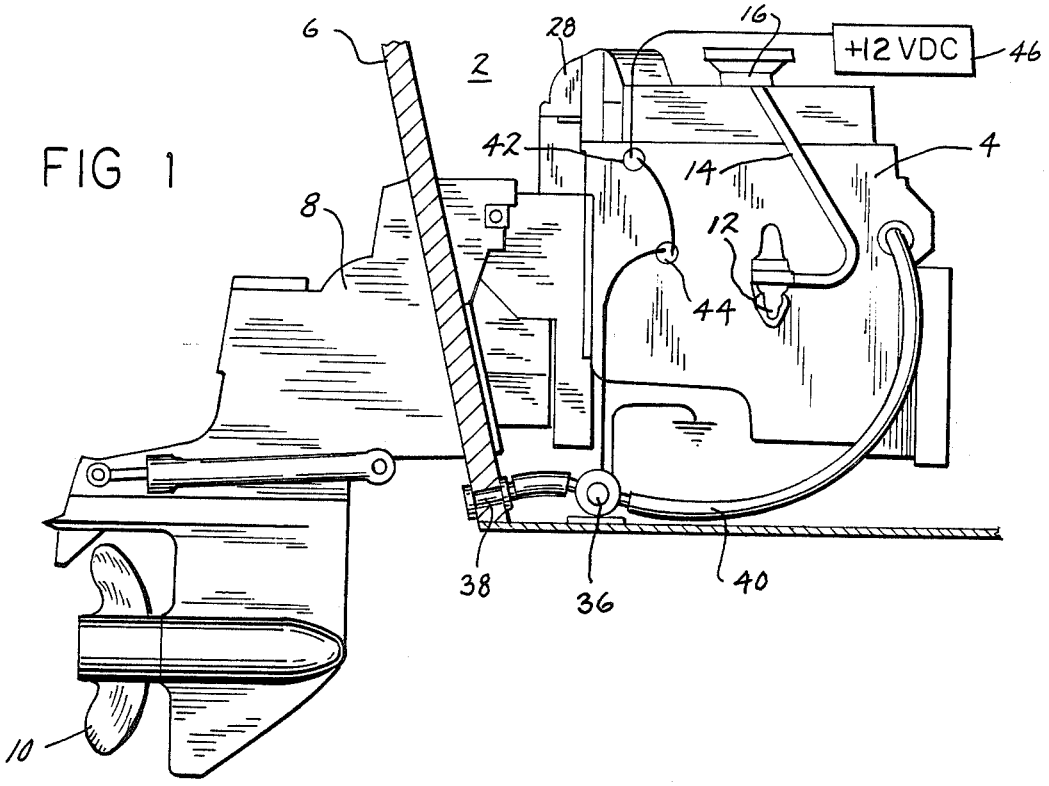
FIG. 1 shows a marine propulsion auxiliary cooling system in accordance with the invention.
Figure 2:
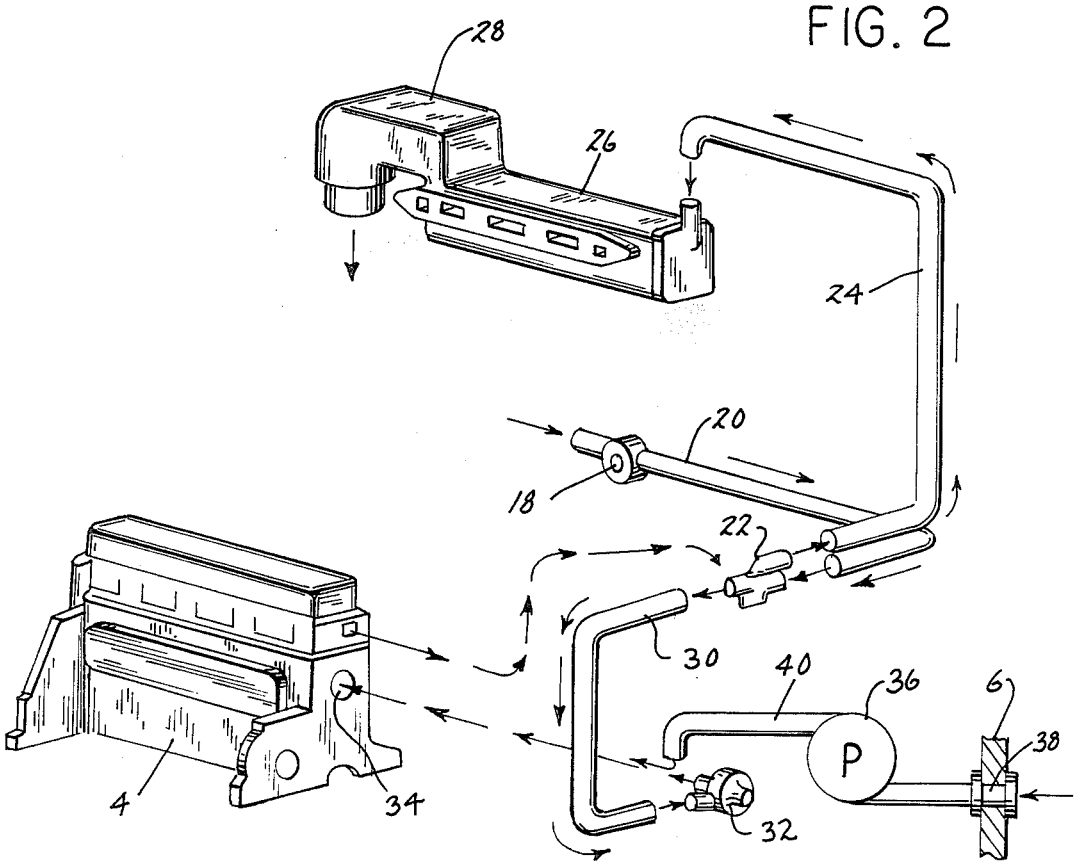
FIG. 2 is an exploded isometric view of a portion of the system in FIG. 1.

FIG. 1 shows a marine propulsion system 2 having a water-cooled internal combustion engine 4 having on and off conditions and drivingly connected through the boat transom 6 to stern gear drive 8 for rotating propeller shaft 10. Fuel supply means are provided by fuel pump 12 drawing fuel from a remote tank (not shown) and delivering the fuel through fuel line 14 to carburetor 16 for combustion by the engine. A portion of FIG. 2 is taken from Mercruiser "Service Training Notebook", 90-90593 4-985, page 127, and shows a Mercury Marine MCM120 engine with standard cooling. The depending stern gear case 8 includes a sea water pickup pump 18 for pumping sea water to the engine, for which further reference may be had to Bloemers et al U.S. Pat. No. 4,392,779 and Kiekhaefer U.S. Pat. No. 2,466,440, incorporated herein by reference. The cooling sea water is delivered on line 20 to thermostat housing 22. When the engine is cold, the thermostat diverts the water to output line 24 and the water flows to exhaust manifold 26 and is discharged at exhaust elbow 28 with the products of combustion, for which further reference may be had to Entringer et al U.S. Pat. No. 4,573,318, incorporated herein by reference. When the engine warms up, the water from input line 20 flows through thermostat 22 to line 30 and is circulated by engine circulating pump 32 to engine 4 at inlet 34.

In accordance with the present invention, an auxiliary electric water pump 36, for example a Johnson Pump International U.S.A. Inc. pump Part No. F3B-1907, is provided with a water inlet 38 through transom 6 and with an outlet 40 connected to engine 4 at the outlet side of circulating pump 32, to provide sea water to the engine to cool the engine and in turn cool the fuel and prevent vaporization of same. A temperature sensor 42, provided by a Datcon Instrument Company Part No. 02019, and an oil pressure sensor 44, provided by a Datcon Instrument Company Part No. 02570, are connected in series with each other and in series between auxiliary electric pump 36 and a source of electrical power provided by the twelve volt DC boat battery 46. When engine temperature is above a given value and oil pressure is below a given value, preferably zero oil pressure meaning that the engine is off, switches 42 and 44 are closed and a circuit is completed from battery 46 to auxiliary water pump 36 to actuate the latter to pump sea water to cool the engine.

Oil pressure sensor 44 provides the means for sensing the off condition of the engine, and auxiliary electric water pump 36 provides off-condition cooling means responsive to such sensing means sensing the off condition and prevents vaporization of the fuel otherwise caused by heat from the engine after the engine is turned off.

Figure 3:
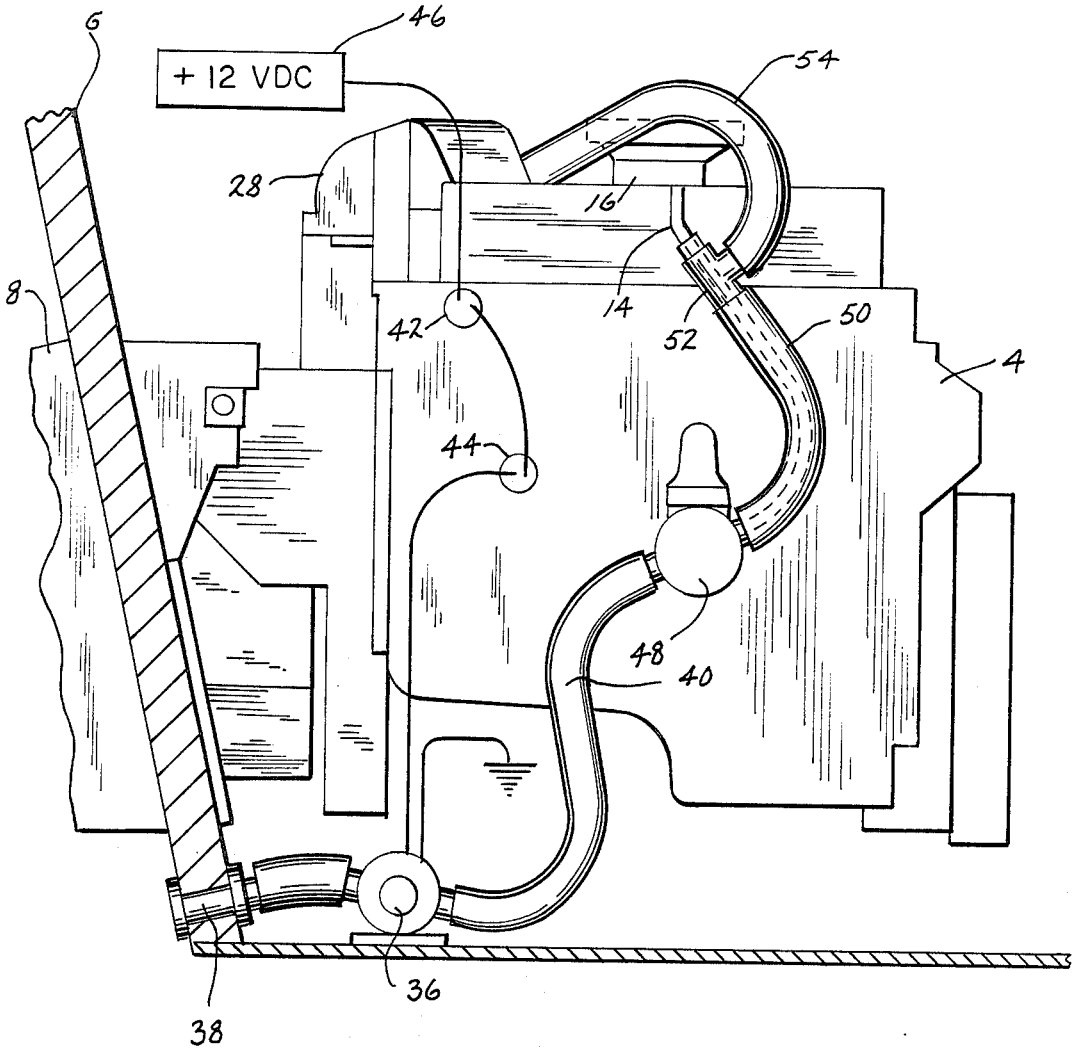
FIG. 3 shows another embodiment of a marine propulsion cooling system in accordance with the invention.

FIG. 3 shows an alternate embodiment and uses like reference numerals from the above figures where appropriate to facilitate clarity. The outlet 40 from auxiliary electric water pump 36 is alternatively or additionally provided to a water cooled fuel pump 48, for example Mickle et al U.S. Pat. No. 3,835,822 and Alden U.S. Pat. No. 2,791,186, incorporated herein by reference. The cooling water from fuel pump 48 is continued through output water line 50 surrounding fuel line 14, and the water continues through elbow joint 52 to output line 54 supplied to exhaust manifold 26 or exhaust elbow 28, as in FIG. 2, or to other outlets for discharging the water, or is directly discharged overboard. The off-condition cooling means thus supplies cooling water in heat transfer relation with fuel line 14 in the off condition of the engine to cool the fuel and prevent vaporization. The inlet of the fuel line cooler is in heat transfer relation with the fuel line and has an inlet at 38 communicating with sea water as the source of cooling water and an outlet at 54 for discharging water which has absorbed heat from the fuel line 14. Though a standard cooling system is shown providing sea water as the cooling water for the engine during the on condition of the engine, the invention including the embodiment shown in FIG. 3 is of course applicable to systems where sea water is provided to a heat exchanger through which engine cooling water is circulated, commonly known as a closed cooling system.

In a further embodiment, the oil pressure sensor 44 is eliminated, and the auxiliary water pump 36 is actuated whenever engine temperature exceeds a given value, regardless of whether the engine is on or off.

It is recognized that various equivalents, alternatives and modifications are possible within the scope of the appended claims.

I claim:

1. In a marine propulsion system having a water-cooled internal combustion engine having on and off conditions and including fuel supply means for supplying fuel to said engine, means for sensing said off condition of said engine, and off-condition cooling means responsive to said sensing means sensing said off condition of said engine and preventing vaporization of said fuel otherwise caused by heat from said engine after said engine is turned off.

2. The invention according to claim 1 wherein said off-condition cooling means comprises means for supplying cooling water to said engine in said off condition to cool said engine and in turn said fuel.

3. The invention according to claim 1 wherein said fuel supply means includes a fuel line, and said off-condition cooling means comprises means for supplying cooling water in heat transfer relation with the said fuel line in said off condition to cool said fuel.

4. The invention according to claim 3 wherein said off-condition cooling means comprises fuel line cooler means in heat transfer relation with said fuel line and having an inlet communicating with a source of cooling water and an outlet for discharging water which has absorbed heat from said fuel line.

5. The invention according to claim 1 wherein said engine has a water pump for pumping cooling water to said engine during said on condition, and wherein said off-condition cooling means comprises an auxiliary pump responsive to said sensing means in said off condition of said engine for pumping cooling water to prevent vaporization of said fuel.

6. The invention according to claim 5 wherein said auxiliary pump pumps sea water as said cooling water in said off condition of said engine.

7. The invention according to claim 5 wherein said engine includes a source of electrical power, and wherein said auxiliary pump comprises an electric pump connected in circuit with said sensing means to said electrical power source, such that in said off condition of said engine said sensing means completes a circuit from said electrical power source to said auxiliary pump to actuate the latter to pump cooling water.

8. The invention according to claim 7 wherein said sensing means comprises a temperature sensor and an oil pressure sensor for actuating said electric auxiliary pump when engine temperature is above a given value and engine oil pressure is below a given value.

9. The invention according to claim 8 wherein said temperature sensor and said oil pressure sensor are electrically connected in series with each other and in series between said electrical power source and said electric auxiliary pump.

* * * * *